US008517900B1

(12) United States Patent
Britt

(10) Patent No.: US 8,517,900 B1
(45) Date of Patent: Aug. 27, 2013

(54) BARBELL POSITIONING SYSTEM

(76) Inventor: Jeremy Britt, Arizona City, AZ (US)

( * ) Notice: Subject to any disclaimer, the term of this patent is extended or adjusted under 35 U.S.C. 154(b) by 407 days.

(21) Appl. No.: 13/050,482

(22) Filed: Mar. 17, 2011

(51) Int. Cl.
*A63B 21/078* (2006.01)
*A63B 21/06* (2006.01)

(52) U.S. Cl.
USPC ..... 482/104; 482/93; 482/94

(58) Field of Classification Search
USPC ..... 482/92, 93, 94, 104, 106; 211/60.1; D21/662, 673, 679, 680, 686
See application file for complete search history.

(56) References Cited

U.S. PATENT DOCUMENTS

| | | | | | |
|---|---|---|---|---|---|
| 4,249,726 | A | * | 2/1981 | Faust | 482/4 |
| 4,253,662 | A | * | 3/1981 | Podolak | 482/104 |
| 4,256,301 | A | * | 3/1981 | Goyette | 482/104 |
| 4,324,398 | A | | 4/1982 | Hole | |
| 4,471,956 | A | | 9/1984 | Marlo | |
| 4,561,651 | A | * | 12/1985 | Hole | 482/104 |
| 4,781,374 | A | * | 11/1988 | Lederman | 482/103 |
| 4,826,155 | A | * | 5/1989 | James | 482/43 |
| 4,875,676 | A | * | 10/1989 | Zimmer | 482/104 |
| 4,949,959 | A | | 8/1990 | Stevens | |
| 4,998,723 | A | * | 3/1991 | Santoro | 482/104 |
| D316,440 | S | | 4/1991 | Ekern | |
| 5,048,826 | A | * | 9/1991 | Ryan | 482/7 |
| 5,151,072 | A | * | 9/1992 | Cone et al. | 482/104 |
| 6,379,287 | B1 | | 4/2002 | Slawinski et al. | |
| 6,558,299 | B1 | * | 5/2003 | Slattery | 482/93 |
| 6,926,649 | B2 | * | 8/2005 | Slawinski | 482/104 |
| 7,001,314 | B1 | * | 2/2006 | Hummer, Jr. | 482/104 |
| 7,070,546 | B1 | * | 7/2006 | Grasso | 482/103 |
| 7,226,400 | B1 | * | 6/2007 | Gedeon-Janvier | 482/104 |
| 2009/0137368 | A1 | * | 5/2009 | Parrilla | 482/104 |

* cited by examiner

*Primary Examiner* — Loan Thanh
*Assistant Examiner* — Sundhara Ganesan

(57) ABSTRACT

A barbell positioning system featuring a frame with a set of weights attached to a pulley positioned in the back of the frame, the pulley extends forwardly and connects to two sliding bases slidably attached to the front posts of the frame. Two resting bases are temporarily attached to the front posts below the sliding bases. The sliding bases are adapted to pivot when the sliding bases come in contact with the resting bases. When a barbell is placed on the sliding bases, the sliding bases slide downwardly and contact the resting bases whereupon the resting bases pivot the sliding bases causing the barbell to be dumped from the sliding bases to the resting bases.

7 Claims, 8 Drawing Sheets

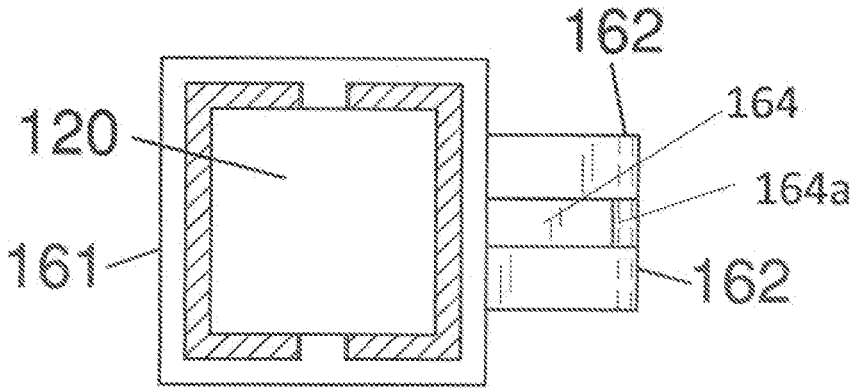
FIG. 5
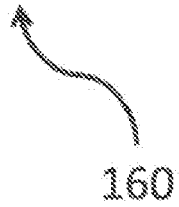

BARBELL POSITIONING SYSTEM

FIELD OF THE INVENTION

The present invention is directed to a system for barbells, more particularly to a system that controls the positioning of barbells, for example the raising and the lowering of the barbells.

BACKGROUND OF THE INVENTION

Many weight lifters raise a weight up to their shoulders and then drop the weight to the ground. This can cause damage to the equipment and floor, and even cause injury to the individual. The present invention features a barbell positioning system. The barbell positioning system of the present invention controls the ascent and descent of weights, preventing weights from being quickly dropped to the ground.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a barbell positioning system 100. The barbell positioning system 100 of the present invention controls the ascent and descent of weights, preventing weights from being quickly dropped to the ground. In some embodiments, the system 100 of the present invention comprises a frame 110, the frame 100 comprising a first front post 120*a*, a second front post 120*b*, a first back post 130*a*, and a second back post 130*b*, wherein a top end of the first front post 120*a* is connected to a top end of the first back post 130*a* via a first connecting post 140*a*, and a top end of the second front post 120*b* is connected to a top end of the second back post 130*b* via a second connecting post 140*b*; a set of weights 150 positioned in between the first back post 130*a* and the second back post 130*b*, the set of weights 150 is slidably attached to a pin pulley 158, the set of weights 150 is divided into weight plates each with a fixed amount of weight, each weight plate comprising a pin slot 151 adapted to receive a weight pin 152, wherein when the weight pin 152 is inserted into the pin slot 151, the weight pin 152 engages the pin pulley to which the weight plates are slidably attached, the pin pulley 158 splits above the set of weights 150 into a first arm 158*a* and a second arm 158*b*, the first arm 158*a* extends through the first connecting post 140*a* and a portion of the first front post 120*a* and the second arm 158*b* extends through the second connecting post 140*b* and a portion of the second front post 120*b*; a first sliding base 160*a* slidably disposed on the first front post 120*a*, and a second sliding base 160*b* slidably disposed on the second front post 120*b*, the first sliding base 160*a* and the second sliding base 160*b* are adapted to slide up and down the first front post 120*a* and second front post 120*b*, respectively, wherein the first arm 158*a* of the pin pulley 158 engages the first sliding base 160*a* and the second arm 158*b* of the pin pulley 158 engages the second sliding base 160*b*, each sliding base 160 comprises (i) an outer frame 161 that wraps around the respective front post 120, (ii) a hook component 162 extending forwardly from the outer frame 161, the hook component 162 is adapted to hold up the a barbell 102, and (iii) a pivot center 164 disposed in a center of the hook component 162, the pivot center 164 has an inner end facing the outer frame 161 of the sidling base 160 and an outer end extending away from the outer frame 161 of the sliding base 160, the outer end of the pivot center 164 is pivotally attached to the hook component 162 via a pivot component 164*a* and the inner end of the pivot center 164 is adapted to pivot upwardly with respect to the outer end of the pivot center 164; and a first resting base 190*a* removably attached to the first front post 120*a* and positioned below the first sliding base 160*a*, and a second resting base 190*b* removably attached to the second front post 120*b* and positioned below the second sliding base 160*b*, each resting base 190 comprises (i) a vertical plate 191 for attaching to the respective front post 120, (ii) a tray 192 that extends outwardly and perpendicularly from the vertical plate 191, and (iii) a top extension 193 that extends upwardly from the tray 194, the top extensions 193 are positioned next to the front posts 120.

When a barbell 102 is placed on the sliding bases 160 the sliding bases 160 slide downwardly along the front posts 120 and the top extensions 193 of the resting bases 190 contact the inner ends of the pivot center 164 of the sliding bases 160 causing the inner ends of the pivot centers 164 to pivot upwardly about the pivot components 164*a*, which allows the barbell 102 to fall onto the trays 194 of the resting bases 190.

In some embodiments, the system further comprises a crossbar 145 extending from the first connecting post 140*a* to the second connecting post 140*b*. In some embodiments, the system further comprises a first spring disposed in the front first post 120*a* and a second spring 170*b* disposed in the second front post 120*b*, a bottom end of the first spring 170*a* is attached to the first sliding base 160*a* and a top end of the first spring 170*a* faces the top end of the first front post 120*a*, a bottom end of the second spring 170*b* is attached to the second sliding base 160*b* and a top end of the second spring 170*b* faces the top end of the second front post 120*b*. In some embodiments, the system further comprises a plurality of pinholes disposed in each the first front post 120*a* and second front post 120*b*, the pinholes are adapted to receive a pin 180, the pin 180 functions to limit how high the sliding bases 160 can slide along the respective front posts 120.

In some embodiments, the resting bases 190 are temporarily secured to the front posts 120 via locking pins 198 that engage pinholes disposed in the front posts 120. In some embodiments, the resting bases 190 each further comprise a tray hook 195 disposed on an outer end of the tray 194 to help prevent a barbell 102 from rolling off of the tray 194. In some embodiments, the top extensions 193 are triangular or pyramidal in shape.

BRIEF DESCRIPTION OF THE DRAWINGS

FIG. 5 is a top cross sectional view of a sliding base of the barbell positioning system of FIG. 1.

DESCRIPTION OF PREFERRED EMBODIMENTS

Figure 1:
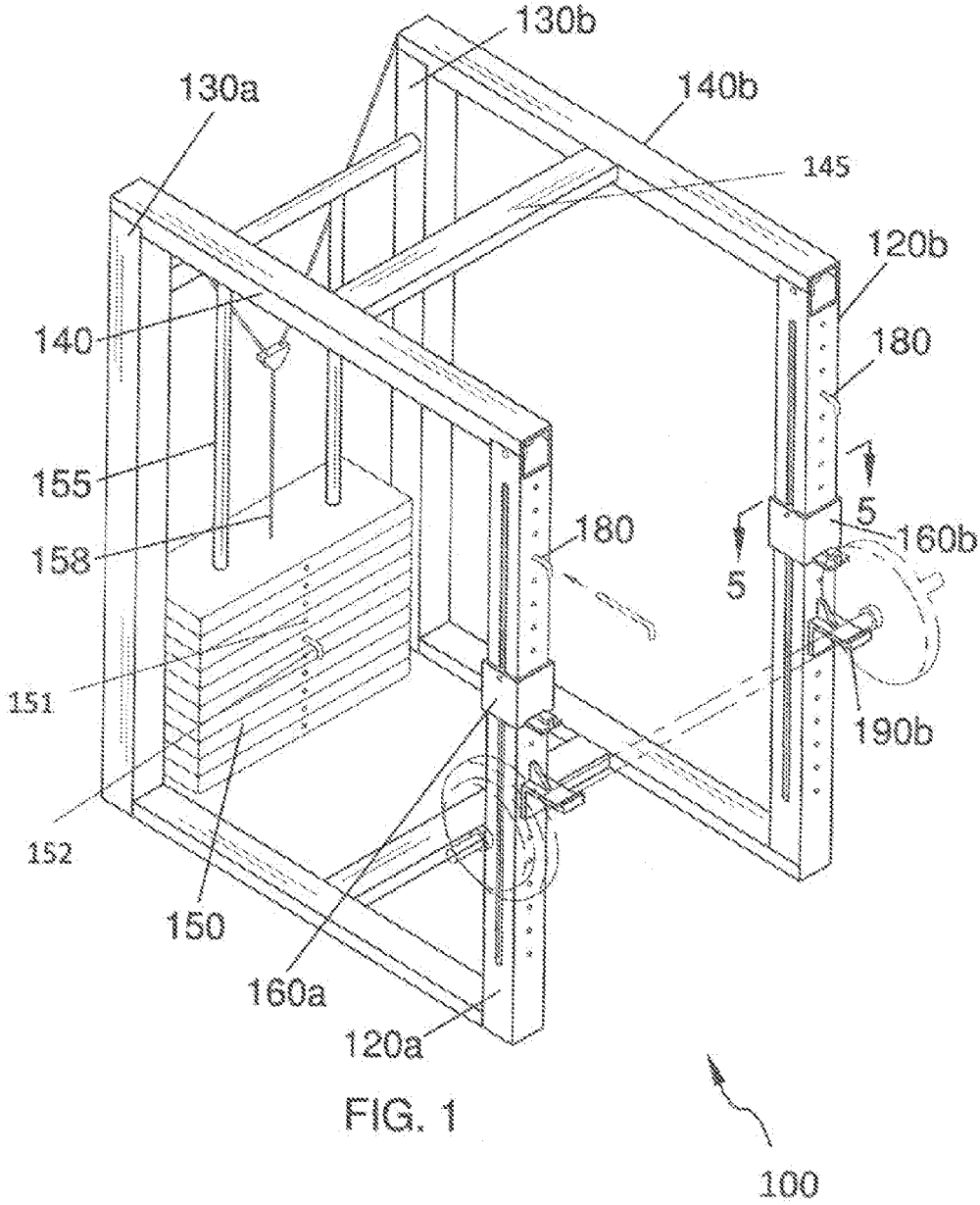
FIG. 1 is a perspective view of the barbell positioning system of the present invention.
Figure 2:
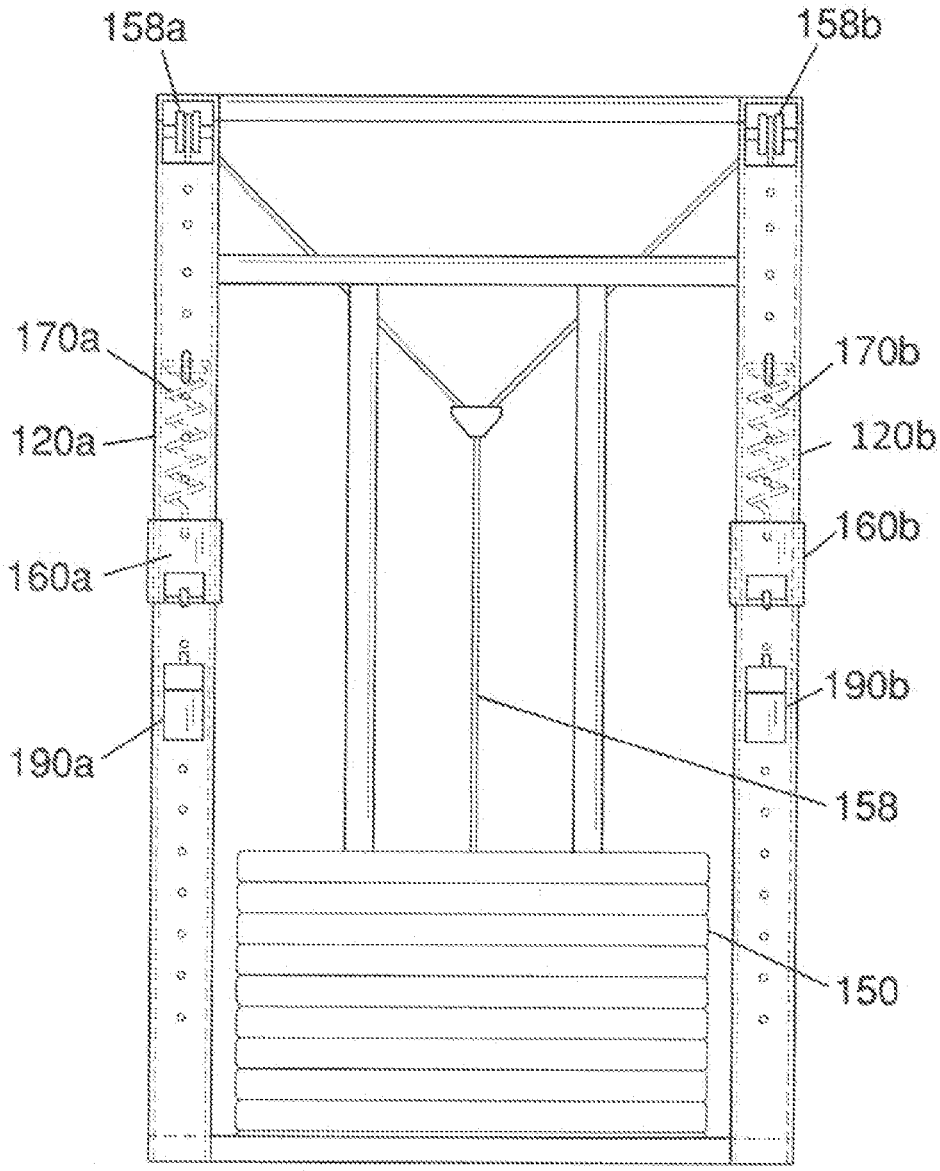
FIG. 2 is a front view of the barbell positioning system of FIG. 1.
Figure 3:
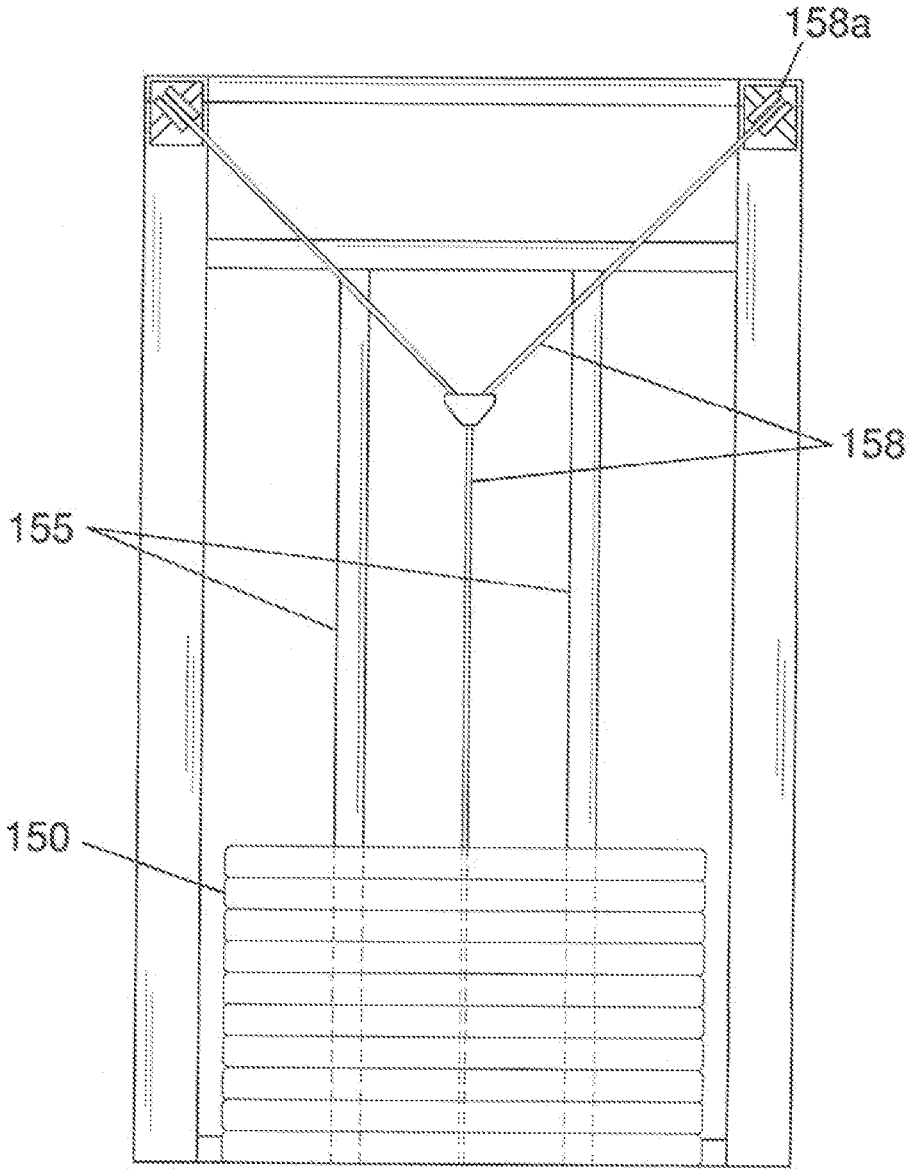
FIG. 3 is a back view of the barbell positioning system of FIG. 1.
Figure 4:
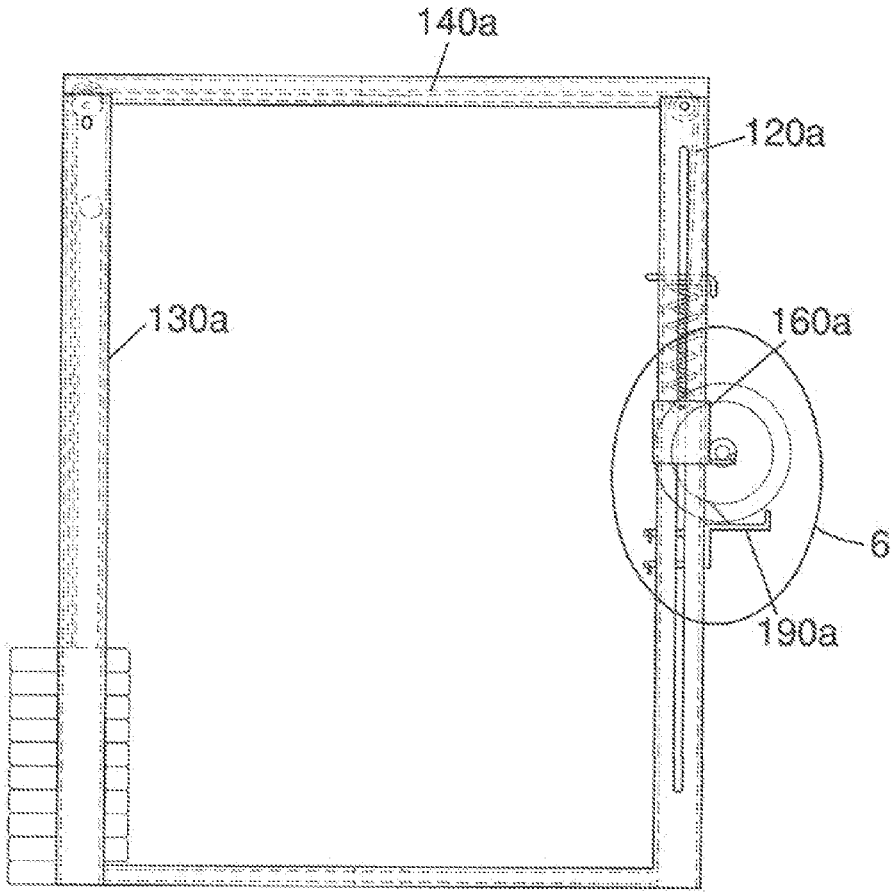
FIG. 4 is a side view of the barbell positioning system of FIG. 1.
Figure 6A:
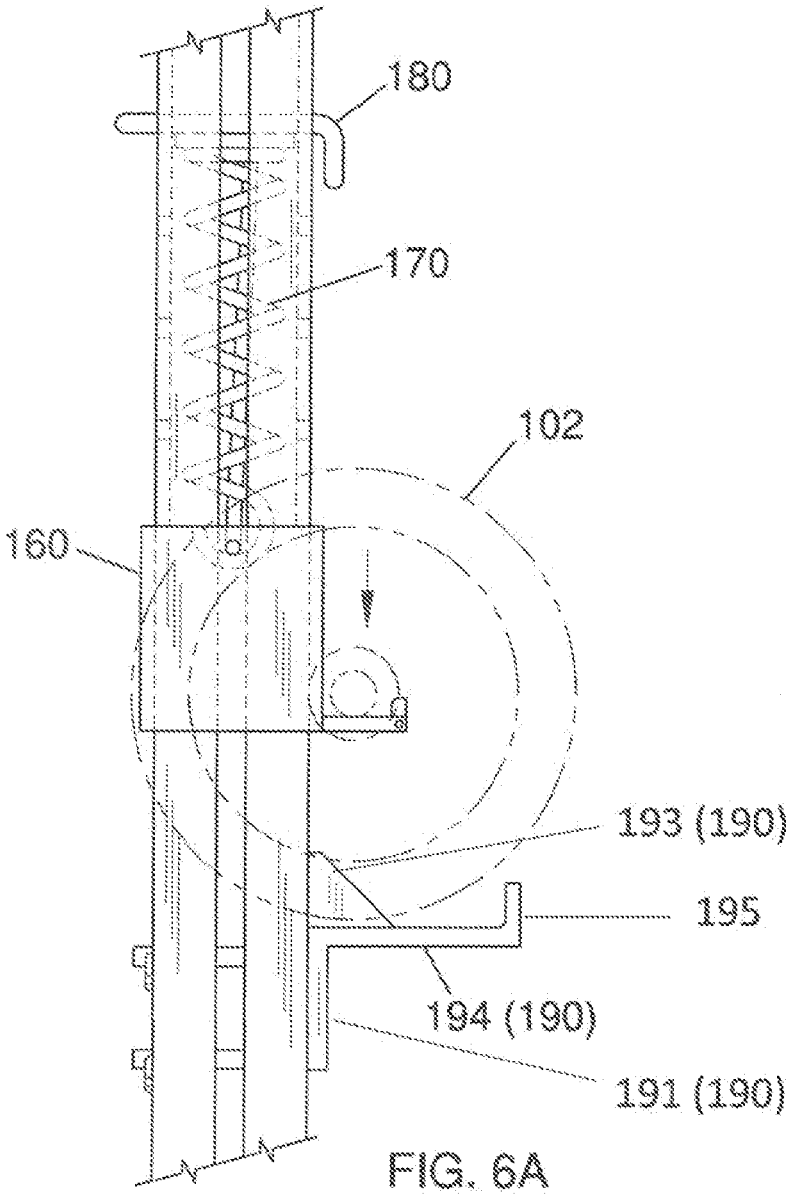
FIG. 6A is a detailed view of the sliding base and resting base of the barbell positioning system of FIG. 4, wherein the pivot component of the sliding base is in the locked position.
Figure 6B:
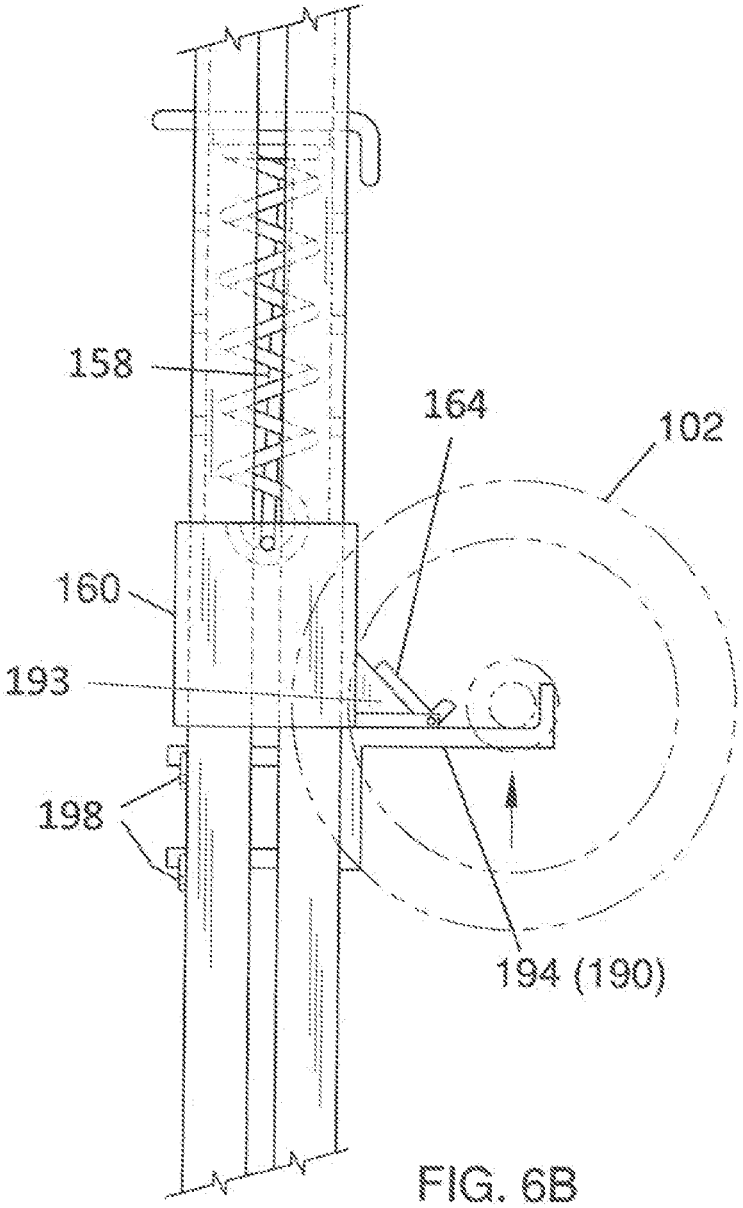
FIG. 6B is a detailed view of the sliding base and resting base of the barbell positioning system of FIG. 4, wherein the hook component of the sliding base is pivoted downwardly to the unlocked position.

Referring now to FIG. 1-7, the present invention features a barbell positioning system. The barbell positioning system 100 of the present invention controls the positioning of weights (e.g., the ascent and descent of weights), preventing weights from being quickly dropped to the ground. The barbell positioning system 100 of the present invention can help prevent damage to equipment as well as injury to the weight lifter.

The barbell positioning system 100 of the present invention comprises a frame 110. The frame 110 may be generally cuboidal, however the frame 110 is not limited to this shape. Generally, the frame comprises a first front post 120*a*, a second front post 120*b*, a first back post 130*a*, and a second back post 130*b*. The top end of the first front post 120*a* is connected to the top end of the first back post 130*a* via a first connecting post 140*a*, and the top end of the second front post 120*b* is connected to the top end of the second back post 130*b* via a second connecting post 140*b*. A crossbar may extend from the first connecting post 140*a* to the second connecting post 140*b*.

The frame 110 may be constructed in a variety of sizes. For example, in some embodiments, the frame 110 is between about 8 to 10 feet in height as measured from the bottom ends of the front posts 120 to the top ends of the front posts 120. In some embodiments, the frame 110 is between about 10 to 12 feet in height as measured from the bottom ends of the front posts 120 to the top ends of the front posts 120. In some embodiments, the frame 110 is between about 4 to 8 feet (e.g., 5 feet) in width as measured from the first front post 120*a* to the second front post 120*b*. In some embodiments, the frame 110 is between about 4 to 10 feet in length (e.g., 6 feet, 8 feet) as measured from the first front post 120*a* to the first back post 130*a*. The frame 110 is not limited to the aforementioned dimensions.

A set of weights 150 is positioned in between the first back post 130*a* and second back post 130*b*. The set of weights 150 is slidably attached to a set of sliding posts 155 and a pin pulley 158. The set of weights 150 is divided into weight plates with a fixed amount of weight, each plate comprising a pin slot adapted to receive a pin. When the pin is inserted into the pin slot, it engages the pin pulley to which the weights are slidably attached. Such sets of weights with pin slots are well known to one of ordinary skill in the art. For example, a user can select an amount of weight and slide a pin into in the pin slot that will correspond to that amount of weight. For example, if each weight plate weighs 10 pounds and the user wishes to select 30 pounds, he/she would slide the pin into the weight plate that is the third plate from the top. The selected plate as well as the two plates above total 30 pounds.

The pin pulley 158 to which the set of weights 150 is slidably engaged extends through the connecting posts 140 and down through a portion of the front posts 120. For example, the pin pulley 158 splits into a first arm 158*a* that extends through the first connecting post 140*a* and first front post 120*a* and a second arm 158*b* that extends through the second connecting post 140*b* and the second front post 120*b*. The pin pulley 158 (e.g., the arms) may engage various pulley components disposed in the front posts 120, back posts 130, and/or connecting posts 140.

A first sliding base 160*a* is slidably disposed on the first front post 120*a*, and a second sliding base 160*b* is slidably disposed on the second front post 120*b*. The sliding bases 160 are adapted to slide up and down the respective front posts 120. The first arm 158*a* of the pin pulley 158 engages the first sliding base 160*a*, and the second arm 158*b* of the pin pulley 158 engages the second sliding base 160*b*. The set of weights 150 thus functions as a counterweight to weight added to the sliding bases 160.

As shown in FIG. 5, the sliding bases 160 each comprise an outer frame 161 that wraps around the respective front post 120. Extending forwardly from the front of the outer frame 161 is a hook component 162. The hook component 162 is adapted to hold up the bar of a barbell. Disposed in the center of the hook component 162 is a pivot center 164 (having an inner end facing the outer frame 161 of the sidling base 160 and an outer end extending away from the outer frame 161 of the sliding base 160). The outer end of the pivot center 164 is pivotally attached to the hook component 162 (in the center of the hook component 162) via a pivot component 164*a* (e.g., a pivot pin, etc.). The pivot center 164 is adapted to pivot with respect to the hook component 162 surrounding the pivot center 164. For example, the inner end of the pivot center 164 pivots upwardly with respect to the outer end of the pivot center 164.

In some embodiments, a first spring 170*a* is disposed in the first front post 120*a* and a second spring 170*b* is disposed in the second front post 120*b*. In some embodiments, the first spring 170*a* (e.g., the bottom end) is attached to the first sliding base 160*a* and the top end of the first spring 170*a* faces (but is not attached to) the top end of the first front post 120*a*. In some embodiments, the top end of the first spring 170*a* is attached to the first arm 158*a* of the pin pulley 158 and the bottom end of the first spring 170*a* faces (but is not attached to) the first sliding base 160*a*. In some embodiments, the second spring 170*b* (e.g., the bottom end) is attached to the second sliding base 160*b* and the top end of the second spring 170*b* faces (but is not attached to) the top end of the second front post 120*b*. In some embodiments, the top end of the second spring 170*b* is attached to the second arm 158*b* of the pin pulley 158 and the bottom end of the second spring 170*b* faces (but is not attached to) the second sliding base 160*b*. The springs 170 may help to provide shock absorption. For example, once a barbell 102 has been dumped off the sliding base 160, the set of weights 150 retracts the sliding base 160 and the springs 170 help prevent damage to the set of weights 150 (by providing a cushion between the sliding bases 160 and top ends of the front posts 120). The springs 170 may also help to ensure smooth movement of the sliding bases 160 along the respective front posts 120. The springs 170 may be sufficiently stiff and long so to prevent a violent collision of the set of weights 150, but not so much as to foul the mechanism of the sliding base 160. An alternate embodiment of the present invention may employ a hydraulic piston for this function, which may connected to both the respective top ends of the front posts 120 and sliding bases 160.

A plurality of pinholes are disposed in each the first front post 120*a* and second front post 120*b*. The pinholes are adapted to receive a pin 180. The pins 180 may function to limit how high and how low the sliding bases 160 can slide along the respective front posts 120. The pins 180 may also function to provide a base for the springs 170 (e.g., shock absorbers) to push off of as well as to enable a user to choose an appropriate height for the sliding bases 160.

A first resting base 190*a* is disposed (e.g., slidably or removably) on the first front post 120*a* positioned below the first sliding base 160*a*. A second resting base 190*b* is disposed (e.g., slidably or removably) on the second front post 120*b* positioned below the second sliding base 160*b*. The resting bases 190 are adapted to be positioned along the respective font posts 120 and secured via locking pins 198 (e.g., twisted pins) that engage pinholes in the front posts 120. For example, a user can select an appropriate position for the resting bases 190 on the front posts 120 (e.g., near the bottom ends of the front posts 120, near the middle of the front posts 120, etc.) and secure the resting bases 190 in place via the locking pins 198.

Generally, the resting bases 190 each comprise a vertical plate 191 that engages the respective front post 120 (via the locking pins 198) and a tray 194 that extends generally perpendicularly to the vertical plate 191 outwardly from the vertical plate 191. The tray 194 functions to hold the barbell 102 when the barbell 102 is moved from the sliding base 160 to the resting base 190. The trays 194 of the resting bases 190 may be longer (e.g., extend further away from the front posts 120) than the sliding bases 160 (e.g., see FIG. 6A and FIG. 6B).

A tray hook 195 may be disposed on the outer end of the tray 194 to help prevent the barbell 102 from rolling off of the tray 194 portion of the resting base 190. The resting bases 190 each also comprise a top extension 193 that extends upwardly from the tray 194. The top extensions 193 are generally positioned next to the front posts 120 (e.g., opposite the tray hooks 195). The top extensions 193 may be a generally triangular or pyramidal in shape, however the top extensions 193 are not limited to these shapes. The shape of the top extensions allows for the sliding bases 160 (e.g., the pivot centers 164) to perform its function. For example, when the sliding bases 160 slide downwardly along the front posts 120 the sliding bases 160 contact the top extensions 193 of the resting bases 190. The top extensions 193 force the pivot center 164 of the sliding bases 160 to pivot (e.g., pivoting upwardly to roll the barbell 102 off onto the resting base 190, which catches the barbell 102). Thus, any shape that allows for forcing the pivot center 164 to drop the barbell 102 onto the resting bases 190 is conceivable.

To use the system 100 of the present invention, a user selects the amount of weight he/she wishes to lift. Then, the user slides a pin into a pin slot in the set of weights 150 at the back of the frame 110. The weights 150 function as counterweights used to slow down the descent of the barbell 102 when the barbell 102 is placed on the sliding bases 160 (at the top of the lift). Generally, the weight selected on the set of weights 150 should correspond to about the amount to be lifted on the barbell 102. The user then positions the resting bases 190 to a position of his/her choice (e.g., near the bottom ends of the posts 120, near the middle, etc.). The positioning of the resting bases 190 can also be done prior to selecting weight on the set of weight 150. The barbell 102 is lifted (e.g., once, multiple times depending on the exercise); when the user has finished the lifting process, he/she places the barbell 102 on the sliding bases 160. Because of the counterweight (set of weights 150), the barbell 102 is slowly lowered along the front posts 120 on the sliding bases 160. When the sliding bases 160 contact the resting bases 190, the inner ends of the pivot centers 164 of the sliding bases 160 are pivoted upwardly about the pivot components 164*a* via the top extensions 193 of the resting bases 190, allowing the barbell 102 to be dumped onto the resting bases 190. The sliding bases 160 slowly return to their original position, and the barbell 102 is ready for another lifting set. The pivot centers 164 of the sliding bases 160 may resume their original positions prior to being pivoted upwardly via the top extensions 193 of the resting bases 190.

As used herein, the term "about" refers to plus or minus 10% of the referenced number. For example, an embodiment wherein the frame 110 is about 5 feet in width includes a frame 110 that is between 4.5 and 5.5 feet in width.

Figure 7:
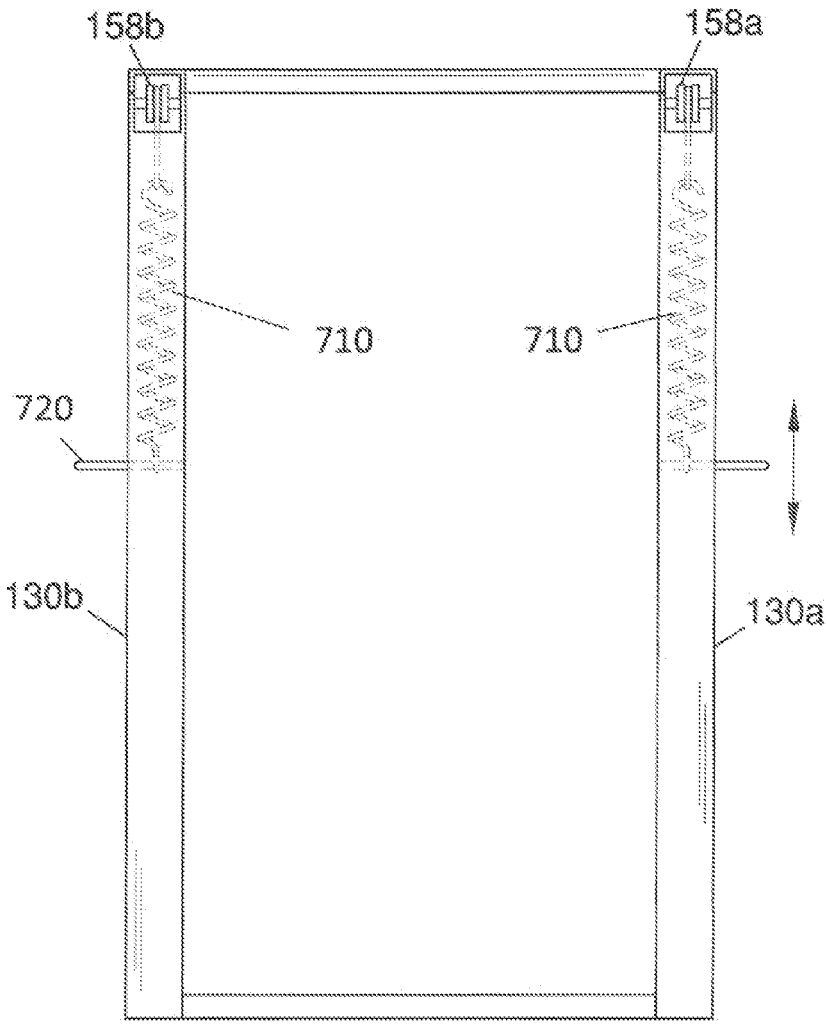
FIG. 7 is a back view of an alternative embodiment of the barbell positioning system of the present invention.

As shown in FIG. 7, the counterweight (e.g., set of weights 150) may be replaced by a spring tension system 710 or a rubber band-type system (both systems must be adjusted, e.g., via adjustment handles 720, by the user to choose appropriate weights). Such systems are well known to one of ordinary skill in the art. In some embodiments, the system 100 is bolted to the ground surface, which may help to stabilize the system 100 (e.g., if a spring-tension system or rubber band-type system is used and there are no counterweights to help balance the system 100).

The disclosures of the following U.S. Patents are incorporated in their entirety by reference herein: U.S. Pat. No. 4,471,956; U.S. Pat. No. 4,324,398; U.S. Pat. No. 5,151,072; U.S. Pat. No. 4,949,959; U.S. Pat. No. 6,379,287; U.S. Design Pat. No. D316,440.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A barbell positioning system comprising:

(a) a frame, the frame comprising a first front post, a second front post, a first back post, and a second back post, wherein a top end of the first front post is connected to a top end of the first back post via a first connecting post, and a top end of the second front post is connected to a top end of the second back post via a second connecting post;

(b) a set of weights positioned in between the first back post and the second back post, the set of weights is slidably attached to a pin pulley, the set of weights is divided into weight plates each with a fixed amount of weight, each weight plate comprising a pin slot adapted to receive a weight pin, wherein when the weight pin is inserted into the pin slot, the weight pin engages the pin pulley to which the weight plates are slidably attached, the pin pulley splits above the set of weights into a first arm and a second arm, the first arm extends through the first connecting post and a portion of the first front post and the second arm extends through the second connecting post and a portion of the second front post;

(c) a first sliding base slidably disposed on the first front post, and a second sliding base slidably disposed on the second front post, the first sliding base and the second sliding base are adapted to slide up and down the first front post and second front post, respectively, wherein the first arm of the pin pulley engages the first sliding base and the second arm of the pin pulley engages the second sliding base, each sliding base comprises (i) an outer frame that wraps around the respective front post, (ii) a hook component extending forwardly from the outer frame, the hook component is adapted to hold up the a barbell, and (iii) a pivot center disposed in a center of the hook component, the pivot center has an inner end facing the outer frame of the sidling base and an outer end extending away from the outer frame of the sliding base, the outer end of the pivot center is pivotally attached to the hook component via a pivot component and the inner end of the pivot center is adapted to pivot upwardly with respect to the outer end of the pivot center; and (d) a first resting base removably attached to the first front post and positioned below the first sliding base, and a second resting base removably attached to the second front post and positioned below the second sliding base, each resting base comprises (i) a vertical plate for attaching to the respective front post, (ii) a tray that extends outwardly ad perpendicularly from the vertical plate, and (iii) a top extension that extends upwardly from the tray, the top extensions are positioned next to the front posts;

wherein when a barbell is placed on the sliding bases the sliding bases slide downwardly along the front posts and the top extensions of the resting bases contact the inner ends of the pivot center of the sliding bases causing the inner ends of the pivot centers to pivot upwardly about the pivot components, which allows the barbell to fall onto the trays of the resting bases.

2. The barbell positioning system of claim 1 further comprising a crossbar extending from the first connecting post to the second connecting post.

3. The barbell positioning system of claim 1 further comprising a first spring disposed in the front first post and a second spring disposed in the second front post, a bottom end of the first spring is attached to the first sliding base and a top end of the first spring faces the top end of the first front post, a bottom end of the second spring is attached to the second sliding base and a top end of the second spring faces the top end of the second front post.

4. The barbell positioning system of claim 1 further comprising a plurality of pinholes disposed in each the first front post and second front post, the pinholes are adapted to receive a pin, the pin functions to limit how high the sliding bases can slide along the respective front posts.

5. The barbell positioning system of claim 1, wherein the resting bases are temporarily secured to the front posts via locking pins that engage pinholes disposed in the front posts.

6. The barbell positioning system of claim 1, wherein the resting bases each further comprise a tray hook disposed on an outer end of the tray to help prevent a barbell from rolling off of the tray.

7. The barbell positioning system of claim 1, wherein the top extensions are triangular or pyramidal in shape.

* * * * *